US006631670B2

(12) United States Patent
Baruffaldi

(10) Patent No.: US 6,631,670 B2
(45) Date of Patent: Oct. 14, 2003

(54) DEVICE AND A UNIT FOR LOCKING THE SLIDING OF THE ROD OF A LINEAR ACTUATOR

(75) Inventor: Danilo Baruffaldi, Turin (IT)

(73) Assignee: Ready S.R.L., Grugliasco (IT)

( * ) Notice: Subject to any disclaimer, the term of this patent is extended or adjusted under 35 U.S.C. 154(b) by 0 days.

(21) Appl. No.: 09/979,557

(22) PCT Filed: Mar. 7, 2001

(86) PCT No.: PCT/EP01/02563

§ 371 (c)(1),
(2), (4) Date: Feb. 26, 2002

(87) PCT Pub. No.: WO01/69091

PCT Pub. Date: Sep. 20, 2001

(65) Prior Publication Data

US 2003/0097926 A1 May 29, 2003

(30) Foreign Application Priority Data

Mar. 16, 2000 (IT) ..... TO2000A000246

(51) Int. Cl.[7] ..... F15B 15/26
(52) U.S. Cl. ..... 92/24; 92/28
(58) Field of Search ..... 91/41, 44, 45, 91/18; 92/19, 23, 24, 25, 26, 27, 28

(56) References Cited

U.S. PATENT DOCUMENTS 3,586,138 A * 6/1971 Engle ..... 92/27
6,186,047 B1 2/2001 Baruffaldi ..... 92/24

FOREIGN PATENT DOCUMENTS

| | | | |
|---|---|---|---|
| DE | 2502381 A * | 7/1976 | ..... E05F/3/22 |
| EP | 0 103 555 | 3/1984 | |
| FR | 2 348 384 | 12/1977 | |
| GB | 984952 | 3/1965 | |
| WO | WO 97/30291 | 8/1997 | |

* cited by examiner

*Primary Examiner*—Edward K. Look
*Assistant Examiner*—Thomas E. Lazo
(74) *Attorney, Agent, or Firm*—Merchant & Gould P.C.

(57) ABSTRACT

The locking device comprises a plurality of rolling wedging members consisting of diablo-shaped rollers with two cylindrical end portions and an intermediate portion which is concave according to a generatrix in the form of an arc of circle whose radius corresponds to the half-diameter of a cylindrical rod of the actuator to which the device is associated. The rollers are adapted to be wedged between the rod and convergent surfaces which are formed in a fixed body of the device. The convergent wedging surfaces are convex surfaces having cross-sections in the shape of an arc of circle whose radius of curvature corresponds to the radius of curvature of the arched longitudinal profile of the concave intermediate portions of each of the rollers, as well as to the half-diameter of the rod. Each of the convex surfaces is in engagement with the concave intermediate portion of one of the rollers.

10 Claims, 5 Drawing Sheets

DEVICE AND A UNIT FOR LOCKING THE SLIDING OF THE ROD OF A LINEAR ACTUATOR

Figure 1:
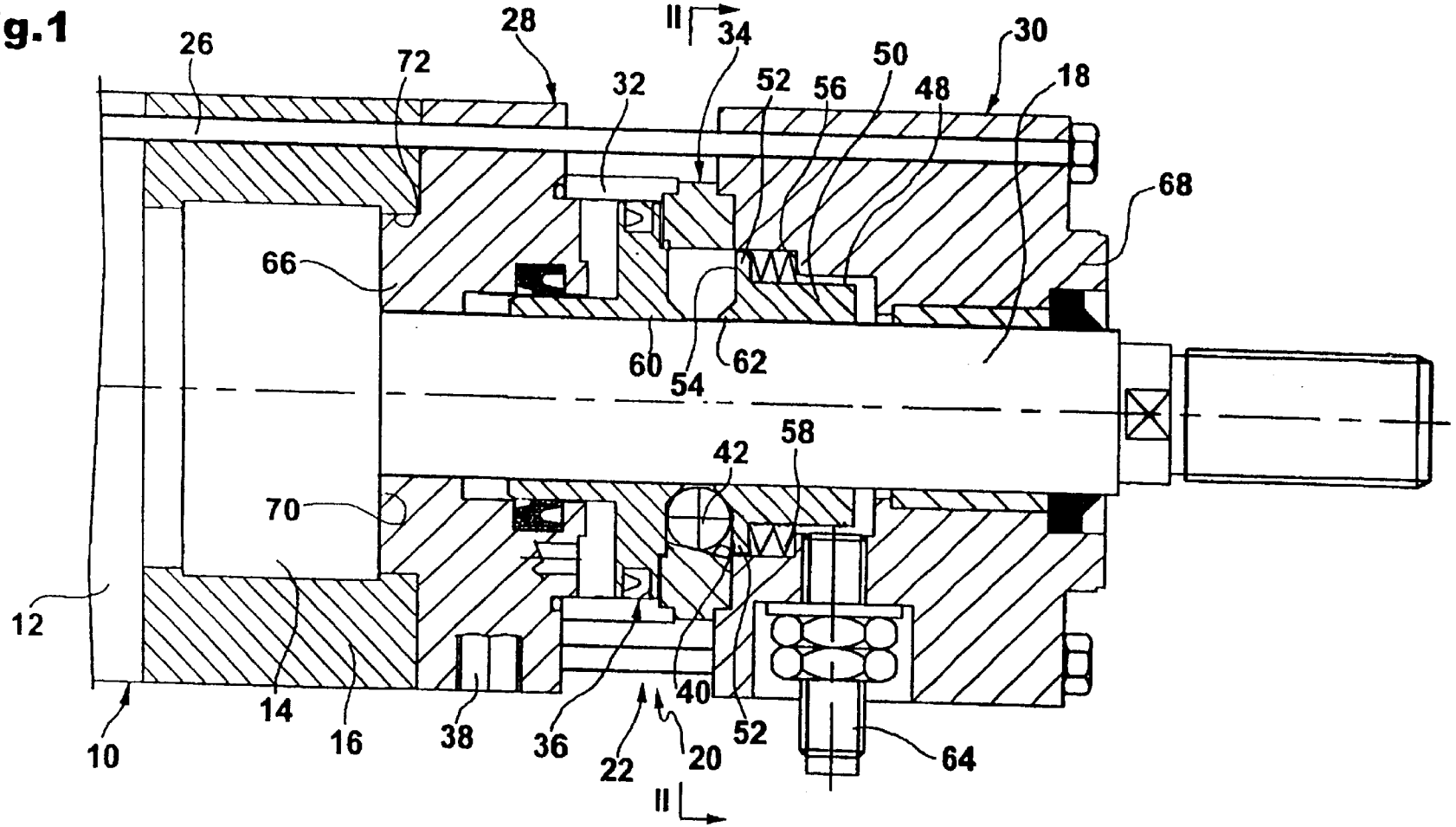

The present invention relates in the first place to a device for the unidirectional locking of a cylindrical rod of a linear actuator, according to the preamble of claim 1.

A device according to the preamble of claim 1 is known from document WO 97/30291, in which the concave intermediate portions of the diabolo-shaped rollers are in rolling engagement with a cylindrical rod of the actuator.

In this known device, the wedging surfaces defined within the outer body of the actuator are formed by flat converging tracks on which the cylindrical end portions of the rollers roll.

In this known arrangement the rollers are subjected to bending stress by the wedging forces as in the case of a beam supported at both ends (the cylindrical portions of the rollers) and loaded in the middle (on the concave intermediate portion of the rollers).

Such bending stress has sometimes given rise, in experimental use, to crackings and breaks of the rollers in the most restricted section of the diabolo shape.

Such crackings and breaks can be avoided by making the rollers of steel materials, with quenching treatments having a high cost which it would be desirable to reduce.

Being aware of the danger of cracking and breakage of the rollers, the latter require expensive quality controls before assembling, in order to allow to discard as from the beginning the rollers which show, in their intermediate section, cracks or other defects which could constitute stress raisers.

The main object of the invention is precisely to provide a locking device of the type considered, which allows to use diabolo-shape rollers made of little expensive materials, even different from steel materials, for example of synthetic material, thanks to the absence of bending stresses in such rollers.

According to the invention, this object is achieved by means of a locking device as claimed.

In a locking device according to the invention the rollers are subjected only to diametral compression forces between two convex wedging surfaces, on the one hand the surface of the rod and, on the other hand, the corresponding wedging surface within the fixed outer body.

As one understands, a body of revolution subjected to compression stress by wedging forces acting thereon only diametrically is able to withstand such forces much better than the same body would do when subjected to bending stress, under equal force conditions.

This allows to choose for the rollers, under equal force condition, a steel of lower quality or even, in certain cases, a synthetic material having a good resistance to both compression and wear, such as for example a polytetrafluoroethylene.

When rollers of the same steel material as those of the known prior art are used, the claimed arrangement allows to obtain a locking device having a higher factor of safety.

Further, given that possible surface defects of the rollers have no influence on their ability to resist to compression, also the quality controls which in any case have to be carried out on the rollers before assembling may represent a lower cost.

The invention also relates to a unit for the bidirectional locking of the sliding of the rod of a linear actuator, which includes a pair of locking devices as claimed, as well as to a linear actuator which includes one of said devices or said unit.

Throughout the present description and in the claims, the terms "axial", "radial", "chordal", their derivatives, as well as similar terms, indicate directions with reference to the axis of the actuator rod.

Figure 2:
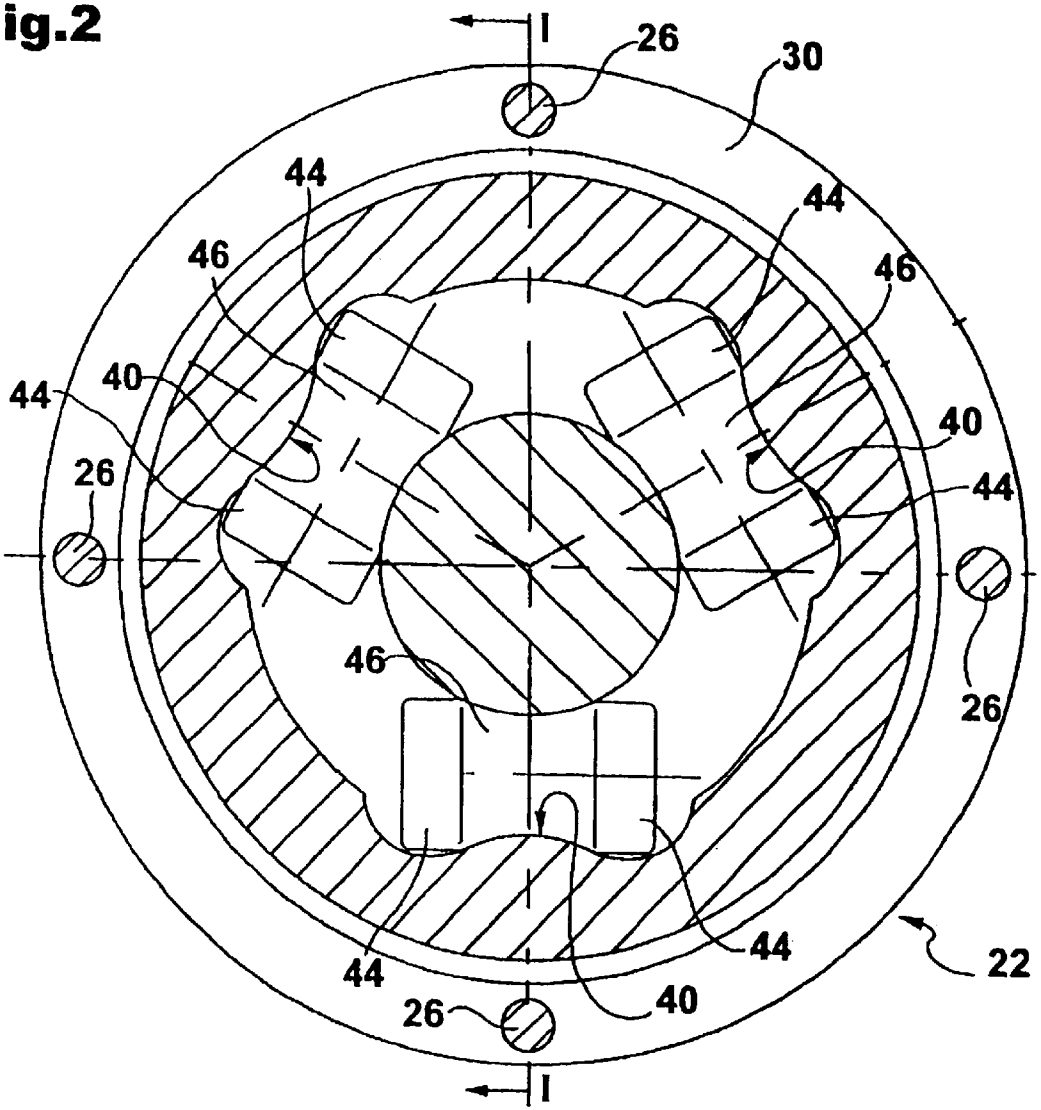
Figure 3:
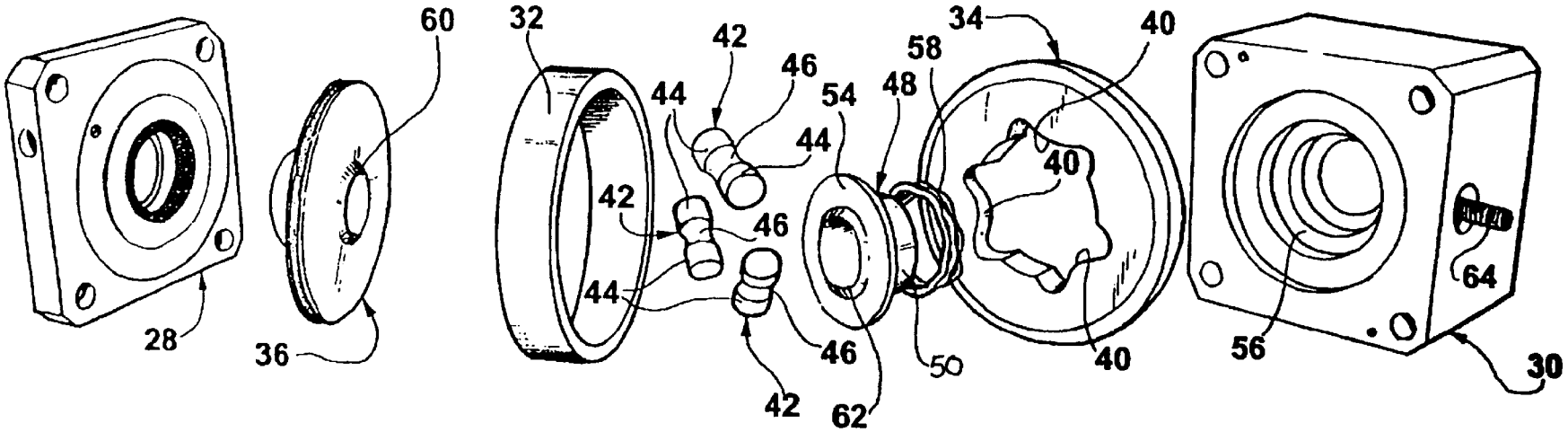
Figure 4:
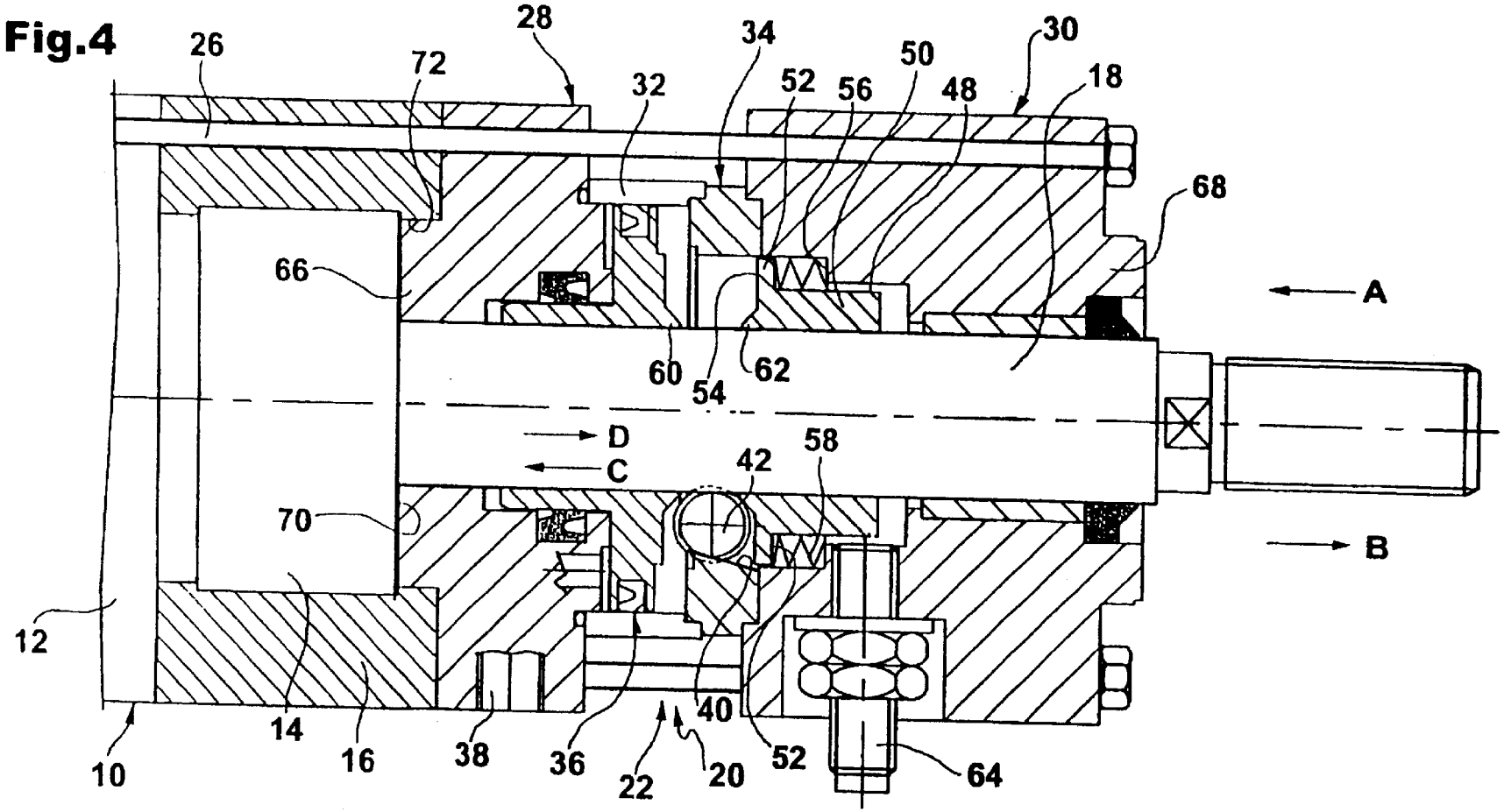
Figure 5:
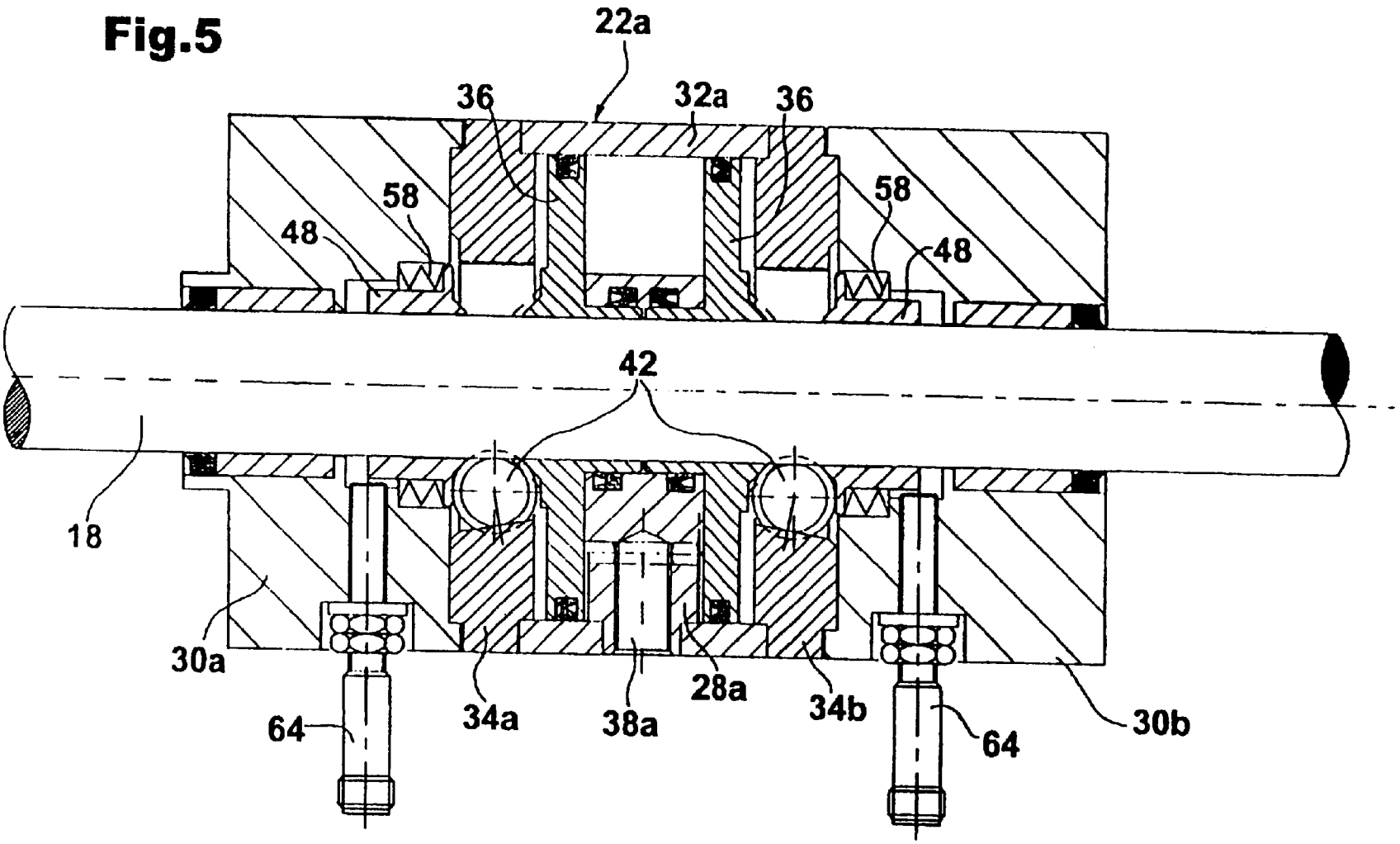

The invention will become clearer from a reading of the following description, given with reference to the appended drawings, provided by way of non-limiting example, in which:

FIG. 1 is a longitudinal section taken on the diametral plane indicated I—I on FIG. 2, of a unidirectional locking device according to a preferred embodiment of the invention, shown in an unlocked condition, FIG. 2 is a transverse section taken in a greater scale in the plane indicated II—II on FIG. 1, FIG. 3 is an exploded, perspective view of the same device, FIG. 4 is a longitudinal section similar to FIG. 1, in which the same device is shown in a locked condition, and FIG. 5 is a longitudinal section corresponding to FIGS. 1 and 4, which shows a bidirectional locking unit.

Referring to FIGS. 1 and 4, 10 indicates a linear actuator only one end of which is shown, to which there is fixed a locking device according to the invention, which will be described more below.

The actuator may be a fluid, hydraulic or pneumatic, actuator or an electromagnetic actuator.

The cylinder or casing of the actuator 10 is indicated 12, and the so-called "nose" of the cylinder is indicated 14.

The "nose" 14 is surrounded by an annular spacer 16.

A movable rod of the actuator is indicated 18 and extends from the "nose" 14.

A device according to the invention, for the unidirectional blocking of the rod 18, is generally indicated 20.

The locking device 20 includes an outer fixed body generally indicated 22.

The fixed body 22 is constituted by a succession of elements which are kept together in a pack, along with the spacer 16, by threaded tie rods 26.

Referring to FIG. 3 as well as to FIGS. 1 and 4, the pack of elements of the body 22 includes a pair of prismatic blocks 28, 30 which constitute opposite heads, and an annular spacer 32 which constitutes a cylinder.

An annular insert 34, whose configuration and function will be clarified more below, is located between the cylinder 32 and the block 30.

An annular disk-shaped piston 32 is slidable in the cylinder 32.

One side of the piston 36 (the one on the left in FIG. 1) is adapted to receive a fluid under pressure from a port 38 in the block 30.

Referring now more particularly to FIGS. 2 and 3, the insert 34 has wedging surfaces 40 formed therein, which in the embodiment shown are in number of three, at 120° from each other.

The wedging surfaces face radially inwardly and converge towards the longitudinal axis of the body 22 and of the rod 18.

A preferred angle of convergence of the surfaces 40 is of between 9° and 15°.

Wedging rolling members, constituted by diabolo-shaped rollers 42, whose axes have a chordal direction, are interposed between each of the wedging surfaces 40 and the rod 18.

Each of these rollers 42 has two cylindrical end portions 44 and an intermediate concave portion 46.

The concave portions 46 are formed according to a generatrix having the shape of an arc of circle of a diameter which corresponds to the diameter of the rod 18, in order to roll in engagement with the latter.

In their turn, all of the convergent wedging surfaces 40 of the insert 34 have a cross-section in the shape of an arc of circle whose radius of curvature corresponds to the radius of curvature of the arched longitudinal profile of the concave intermediate portions 46 of each roller as well as to the half-diameter of the rod 18.

The concave intermediate portion 46 only of each roller 42 is in engagement, on the one hand, with the cylindrical surface of the rod 18 and, on the other hand, with the corresponding convex wedging surface 42. The cylindrical end portions 44 of the rollers 42, although they have no function as regards wedging, because they do not engage either the cylindrical surface of the rod 18 or the convex surfaces 40, have however two specific functions which will be described more below.

Referring again to FIGS. 1 to 4, the locking device includes resilient repulsion means which tend to urge the rollers 42 to a wedged position (to the left in FIGS. 1 and 4).

This wedged position is shown in FIG. 4. Preferably, as shown, the repulsion means comprise a sleeve 48 with a bush-like portion 50 which is longitudinally slidable on the rod 18 and a radial wall constituted by a dish portion 52.

The dish-like portion 52 has a radial annular front face 54 which engages the cylindrical end portions 44 of the rollers 42, for the purpose which will be clarified more below.

The repulsion means further comprise resilient thrust means interposed between an annular surface 56 formed in the block 30 and a facing annular radial surface 58 (FIGS. 1 and 4) which is formed on the dish-like portion 52 on its side opposite to that of the annular face 54 which engages the cylindrical portions 44 of the rollers 42.

Preferably, as can be seen on FIG. 3, the resilient thrust means consist of a helical compression spring 58 with turns of undulated flat wire, made by the Smalley Steel Ring Company of Wheeling, Ill., U.S.A.

The cylindrical end portions 44 of the rollers 42 have also another function, which will be described now.

A device such as that shown in FIGS. 1 to 4 can be supplied as an attachment for actuators of different types.

When the locking device 20 is not mounted on an actuator, the space between the rollers 42 is empty, because the rod 18 is missing.

If some specific measure is not taken, the rollers 42 could not stay in their place and the mounting of the locking device on the actuator could represent an awkward task.

To prevent the rollers 42 from displacing radially inwardly when the rod 18 is missing, the piston 36 and the dish 52 of the sleeve have radially inner annular projections, 60 and 62, respectively, which have a substantially triangular beak-like profile.

The projections 60, 62 engage on both sides the cylindrical end portions 44 of the rollers 42, thus constituting a shoulder which keeps the concave portions 46 in engagement with the convex wedging surfaces 40, also in the absence of the rod 18.

In FIGS. 1, 2, 3 and 4 there is shown a proximity switch 64 which is radially inserted in the block 30 and senses the position of the bush-like portion 50 of the sleeve 48 to send an electrical signal indicating the locked or unlocked position of the device.

It will be assumed that the device is initially in the unlocked condition of FIG. 1. In this condition there is pressure on the face of the piston 36 away from the rollers 46, and the piston 36 is wholly displaced on the right in the figure.

Thus, the piston 36 keeps the rollers 46 and the sleeve 48 in the right-hand position, against the bias of the springs 58.

In such conditions, the rollers 42 are not wedged and the rod 18 is free to slide back and forth.

Referring to FIG. 4, if one wishes to prevent the rod 18 from moving back in the direction of the arrow A at the end of a predetermined outward stroke in the direction of the arrow B, the pressure applied to the piston 36 through the port 38 is removed, so that the piston 36 withdraws in the direction of the arrow C, under the thrust which is exerted by the spring 58 through the dish-like portion 52 and the rollers 52.

Under the action of the spring 58, the dish-like portion 52 of the sleeve 48 urges the respective rollers 48 to the wedging position of FIG. 4, in which they closely engage the convergent surfaces 40, as well as the outer surface of the rod 18.

The rod 18 is not hindered in its outwards movement according to the arrow B, because this movement tends to release the wedging of the rollers 42. When this movement stops, however, any attempt of the rod 18 to move in the opposite direction, indicated by the arrow A, will only increase the wedging of the rollers 42, so that this movement in the direction of the arrow A will not be possible.

To release the rod 18, it simply suffices to admit pressure to the face of the piston 36 which is away from the rollers, through the port 38, so that the piston 48 will move in the opposite direction, indicated by the arrow D in FIG. 4. As it does so, the piston 36 urges the rollers 42 to the unlocked position of FIG. 1, against the force of the spring 58.

As already mentioned before, the proximity switch, which senses the position of the bush-like portion 50 of the sleeve 48, detects the locked and the unlocked conditions of the device.

In FIGS. 1 and 4 the device has been shown in an arrangement by virtue of which it is adapted to lock the inwards movement of the rod 18.

The same device lends itself to the mounting on an actuator in an arrangement thanks to which it is instead adapted to lock the outwards stroke of the rod.

As can be seen on FIGS. 1 and 4, both blocks 28 an 30 have, at their ends remote from each other, an annular positioning boss, 66 and 68, respectively.

In FIGS. 1 and 4, the boss 66 is fitted into an annular seat which is defined by an annular front face 70 of the "nose" 14 and by a radially inner peripheral annular surface 72 of the annular spacer 16.

To set the locking device in the condition in which it is adapted to lock the outwards movement of the rod 18, it is sufficient to invert the position of the device and fit the boss 68 into the seat 70–72.

Reference will now be made to FIG. 5 to describe a unit, according to the invention, for the bidirectional locking of the sliding of the rod of a linear actuator.

The bidirectional locking unit of FIG. 5 comprises a pair of unidirectional locking devices like the one shown in FIGS. 1 to 4, which act in axially opposite directions.

The body 22*a* of the device of FIG. 5 comprises a pack of elements among which a pair of end blocks 30*a*, 30*b*, both equivalent to the block 30 of FIGS. 1, 3 and 4, a pair of inserts 34*a*, 34*b*, with wedging surfaces which are inclined in opposite directions, and an annular spacer 32*a*.

The main elements of these two devices have been indicated by the same reference numerals as in FIGS. 1 to 4.

As will be noted, the annular spacer 32*a* performs the function of a cylinder for a pair of unlocking pistons 36 which act in opposite directions and are fed with a fluid under pressure to simultaneously unlock the two devices from a common port 38*a* which is provided in a central annular insert 28*a*, whose function is equivalent to the function of the block 28 of FIGS. 1, 3 and 4.

It is sufficient to say that, with reference to FIG. 5, to block the movement of the rod 18 in both directions, the pressure applied to the pistons 36 through the port 38*a* will be removed to allow the springs 58 to urge the rollers 42 to the wedged position. To unlock the rod 18, the pressure will be admitted to the pistons 36 through the port 38*a* so that the pistons 36 will urge the rollers 42 back to the unwedged position, against the force of the springs 58.

In an alternative embodiment of a bidirectional locking unit, not shown, the unit could be arranged for the selective locking and unlocking of one and the other of the devices.

In this case the port 38*a* will be substituted by two distinct ports, one for each piston.

What is claimed is:

1. A device for the unidirectional locking of the sliding of a cylindrical rod of a linear actuator, the device comprising:

an outer body fast with or adapted to be fastened to an end of a casing of the actuator in an arrangement such as to surround the rod, means defining, in the body, a plurality of radially inwardly facing wedging surfaces which converge towards a longitudinal axis or the body, a corresponding plurality of wedging rolling members consisting of diabolo-shaped rollers having two cylindrical end portions and an intermediate portion which is concave according to a generatrix in the shape of an arc of circle having a radius which corresponds to the half-diameter of the rod, in order to roll in engagement with the rod, which rollers can be wedged between the said convergent surfaces and the rod as a result of their rolling until a wedged position in one direction and as a result of a constriction of their coupling with the wedging surfaces and the rod, an annular unlocking piston slidable longitudinally in the fixed body and cooperating with the cylindrical end portions of the wedging rollers to urge the rollers back to an unwedged position, and resilient repulsion means which tend to urge the rollers back to the wedged position, wherein the convergent wedging surfaces which are defined in the body are convex surfaces having cross-sections in the shape of an arc of circle whose radius of curvature corresponds to the radius of curvature of the arched longitudinal profile of the intermediate concave portions of each of the rollers as well as to the half-diameter of the rod, and wherein each of the said convex surfaces is in engagement with the intermediate concave portion of one of the rollers.

2. A locking device as claimed in claim 1, wherein the said repulsion means comprise:

a longitudinally slidable sleeve which has a front annular face and is in engagement with the cylindrical end portions of the rollers, and resilient thrust means interposed between annular surfaces, facing each other, of the fixed body and the sleeve.

3. A locking device as claimed in claim 2, wherein the said annular front face and the said facing annular surface which belongs to the sleeve are formed on opposite sides of a radially outer radial annular dish-like portion of the sleeve.

4. A locking device as claimed in claim 2, wherein the resilient thrust means consist of a helical compression spring.

5. A locking device according to claim 4, wherein the helical spring is of a type with undulated turns.

6. A locking device as claimed in claim 1, wherein at least the unlocking piston or at least the sleeve of the repulsion means has a radially inner annular projection which engages the cylindrical end portions of each at the rollers to prevent the radially inwards displacement of the rod.

7. A locking device according to claim 6, wherein the or each annular projection has a substantially triangular beak-like profile.

8. A locking device as claimed in claim 1, wherein the fixed body consists of a succession of elements which are clamped together in a pack by threaded tie rods.

9. A locking device as claimed in claim 8, wherein the fixed body comprises, in succession, a first block having the function of a head, an annular spacer having the function of a cylinder for the unlocking piston, an annular insert in which the wedging surfaces are formed, and a second block having the function of a head.

10. A locking device as claimed in claim 9, wherein both the first block and the second block have identical positioning formations one or the other of which is adapted to be fitted indifferently to an end of an actuator to arrange the device for the locking of a rod of the actuator in the inwards direction or in the outwards direction of movement of the rod.

* * * * *